US007137568B1

(12) United States Patent
LaCrosse

(10) Patent No.: US 7,137,568 B1
(45) Date of Patent: Nov. 21, 2006

(54) APPARATUS AND METHOD FOR FLOW DIVERTER

(76) Inventor: William R. LaCrosse, 3455 Peachtree Industrial Blvd., Duluth, GA (US) 30096

( * ) Notice: Subject to any disclaimer, the term of this patent is extended or adjusted under 35 U.S.C. 154(b) by 0 days.

(21) Appl. No.: 11/143,854

(22) Filed: Jun. 2, 2005

(51) Int. Cl.
*B05B 1/26* (2006.01)
*B05B 17/00* (2006.01)

(52) U.S. Cl. ..... 239/1; 239/11; 239/462; 239/499; 239/511; 239/521; 239/522; 239/524; 239/554; 239/590.5

(58) Field of Classification Search ..... 239/590, 239/590.5, 554, 555, 462, 499, 518, 521, 239/522, 524, 511, 1, 11
See application file for complete search history.

(56) References Cited

U.S. PATENT DOCUMENTS

| | | | | | |
|---|---|---|---|---|---|
| 441,365 | A | * | 11/1890 | Kinder | 239/456 |
| 2,900,139 | A | * | 8/1959 | Hensley, Jr. | 239/499 |
| 3,227,376 | A | * | 1/1966 | Rittenhouse | 239/78 |
| 3,416,735 | A | * | 12/1968 | Reed | 239/567 |
| 3,787,169 | A | * | 1/1974 | Gjerde | 431/347 |
| 4,047,668 | A | | 9/1977 | DeWeese et al. | |
| 4,343,435 | A | | 8/1982 | Anderton et al. | |
| 4,376,511 | A | * | 3/1983 | Franklin, Jr. | 239/14.2 |
| 4,475,691 | A | | 10/1984 | Hintz | |
| 4,497,664 | A | * | 2/1985 | Verry | 134/22.12 |
| 4,815,665 | A | * | 3/1989 | Haruch | 239/432 |
| 4,869,103 | A | | 9/1989 | Jerman | |
| 5,069,073 | A | | 12/1991 | Barrett | |
| 5,190,222 | A | * | 3/1993 | Haruch | 239/523 |
| 5,333,794 | A | * | 8/1994 | Haruch | 239/600 |
| 5,810,044 | A | | 9/1998 | Saidi | |
| 5,964,019 | A | | 10/1999 | Broussard | |
| 6,076,746 | A | * | 6/2000 | Kantor et al. | 239/222.17 |
| 6,082,639 | A | * | 7/2000 | Pentz et al. | 239/655 |
| 6,085,988 | A | * | 7/2000 | Marsh | 239/17 |
| 6,095,429 | A | | 8/2000 | Killgrove et al. | |
| 6,116,525 | A | | 9/2000 | Grimes | |
| 6,117,316 | A | | 9/2000 | Burton | |
| 6,294,096 | B1 | * | 9/2001 | Pate | 210/749 |
| 6,360,970 | B1 | | 3/2002 | Fitzgerald | |

* cited by examiner

*Primary Examiner*—Steven J. Ganey
(74) *Attorney, Agent, or Firm*—Welsh & Flaxman LLC

(57) ABSTRACT

A flow diverter for diverting an initial flow stream of pressurized fluid from a source of pressurized fluid. The flow diverter comprises a housing having an upstream end, an inlet opening in the upstream end, a downstream end generally opposed to the upstream end, a top plate extending between the upstream end and the downstream end, a bottom plate generally opposed to the top plate and extending between the upstream end and the downstream end, and a pair of generally opposed lateral sides extending between the upstream end, the downstream end, the top plate and the bottom plate. The upstream end is adapted to be attached to the source of pressurized fluid and the inlet opening is adapted to receive the initial flow stream of pressurized fluid from the source of pressurized fluid. The downstream end is adapted to divert the initial flow stream of pressurized fluid toward the pair of generally opposed lateral sides. The pair of generally opposed lateral sides are adapted to permit the initial flow stream of pressurized fluid to exit the housing in a pair of generally opposed diverted flow streams of pressurized fluid that are substantially perpendicular to the initial flow stream of pressurized fluid. The pair of generally opposed lateral sides are also adapted to permit the measurement of the initial flow stream of pressurized fluid.

23 Claims, 5 Drawing Sheets

APPARATUS AND METHOD FOR FLOW DIVERTER

FIELD OF THE INVENTION

The invention relates generally to devices and methods for diverting fluid flow, and particularly to devices and methods for diverting water flow in fire hydrants, fire pumps and the like.

BACKGROUND AND DESCRIPTION OF THE PRIOR ART

Water supply systems frequently require testing and purging to comply with local ordinances, operational requirements or safety codes. A perfect example is testing of fire hydrants. Regular testing and purging is required. Fire pumps installed in buildings for fire protection systems also require annual flow testing to meet with fire and safety code requirements.

To test a typical system, temporary hoses are attached to an available connection and the water is released. A playpipe or flow diverter is connected to the end of the hose to allow flow measurements at the exiting water stream. A measurement device, typically a Pitot tube, determines the flow of exiting water. The water is often discharged in the immediate vicinity of the building wall or hydrant. When water under high pressure is released to atmospheric pressure, considerable forces are in play on the discharge stream. Typically the playpipe or flow diverter needs to be restrained during testing. Care must be exercised with regard to where the water is discharged. Damage to the ground, surrounding landscaping, and harm to individuals in the path of the water can occur due to a misdirected water stream.

Fire pump capacities have increased over the years. Up to 12 flow streams may now be required to test a given fire sprinkler system. Stackable flow diverters are now needed to allow better management of the exiting flow streams.

Some tests are performed on building roofs where the device needs to be manually carried up stairs. The portability of the flow diverter is of concern to the operator that has to carry the device. Rooftop tests are seldom available with suitable anchoring positions.

As safety codes and standards have improved over the years, accuracy in testing is of an increasing importance. Accuracy of many current flow diverters has been sacrificed to accommodate for other features. Many currently employ a restricted-position Pitot tube feature which does not allow movement of the Pitot tap location once in use, which is accurate only if the discharge follows a perfect velocity profile. Flow streams however, seldom follow perfect velocity profiles. A fixed position Pitot tube device is never as accurate as an unrestricted access system allowing a qualified operator to seek the most representative velocity pressure reading to determine the flow. Accordingly, a device that provides unrestricted access to the flow stream for an operator will provide for more accurate results.

The difficulty of providing unrestricted access is that water back splash is difficult to control. The difficulty increases as the size of the device reduces. Needless to say, an unrestricted access flow diverter must allow the operator access without getting him wet in the process. The device should prevent any back splash of the fluid in the area where access is required.

Dechlorination is sometimes required by local authorities to remove the affects of chlorine dissolved in the water. An method of treating the water would be beneficial.

Accordingly, a need exits to provide a small, stackable, accessible, portable flow diverter that will dissipate the energy contained in fluid systems to allow for a safe discharge of the flow on any surface without requiring restraints while allowing an operator to obtain an undisturbed access for the highest accuracy flow measurement readings while not getting wet and provide for optional dechlorination. of the water stream.

It would be desirable, therefore, if an apparatus and method for a flow diverter could be provided that would provide accurate testing of high-pressure fluid systems and dissipate the energy produced by a flow stream so as to eliminate the need for anchoring. It would also be desirable if such a flow diverter would provide unrestricted access to a flow stream so as to allow the highest accuracy of flow measurements when using a hand held Pitot tube during the test. It would be further desirable if such a flow diverter would be adapted to minimize damage to the physical grounds and harm to persons in the area surrounding the device resulting from the discharged flow stream. It would be still further desirable if such a flow diverter would be a light-weight device adapted to be easily transported and stored. It would also be desirable if such a flow diverter could be provided that would be adapted to enable the dechlorination of an exiting flow stream. It would be further desirable if such a flow diverter could be provided that would be adapted to minimize back splash so as to allow the operator to take readings without getting wet. It would be still further desirable to provide a flow diverter that has an integrated, stackable design adapted to allow a plurality of units to be placed in a minimum of available space.

ADVANTAGES OF THE INVENTION

Among the advantages of the invention is to provide a flow diverter for accurate testing of high-pressure fluid systems that will dissipate the energy produced by a flow stream using a balanced horizontal thrust design so as to eliminate the need for anchoring. It is also an advantage of the invention to provide a flow diverter that provides unrestricted access to a flow stream so as to allow the highest accuracy of flow measurements when using a hand held Pitot tube during the test. It is another advantage of the invention to provide a flow diverter adapted to minimize damage to the immediate ground surrounding the device resulting from the energy contained in the discharged flow stream. It is still another advantage of the invention to provide a flow diverter that is a light-weight device adapted to be easily transported and stored. It is yet another advantage of the invention to provide a flow diverter adapted to enable the dechlorination of an exiting flow stream. It is also an advantage of the invention to provide a flow diverter that is adapted to minimize back splash so as to allow the operator to take readings without getting wet. It is a further advantage of the invention to provide a flow diverter that has an integrated, stackable design adapted to allow a plurality of units to be placed in a minimum of available space.

Additional advantages of this invention will become apparent from an examination of the drawings and the ensuing description.

Explanation of Technical Terms

As used herein, the term "flow stream of pressurized fluid" refers a moving fluid, including but not limited to water and other liquids, air and other gases, and combinations thereof, to which a force or pressure has been applied.

As used herein, the term "source of pressurized fluid" refers to a device adapted to convey a flow stream of pressurized fluid as defined above. The term "source of pressurized fluid" includes, but is not limited to, hoses, pipes, tubes, manifolds and other similar devices. The term "source of pressurized fluid" also includes, but is not limited to, fire hydrants, fire pumps and other similar devices.

As used herein, the term "a pair of generally opposed diverted flow streams of pressurized fluid" refers to two or more flow streams of moving fluid that are directed such that the horizontal thrust forces produced by the flow stream or flow streams diverted to each generally opposed lateral side of the housing of the flow diverter are substantially equal.

As used herein, the term "a pair of generally opposed diverted flow streams of pressurized fluid that are substantially perpendicular to the initial flow stream of pressurized fluid" refers to two or more flow streams of moving fluid that are directed at an angle of no less than approximately forty-five degrees (45°) and no greater than one hundred thirty-five degrees (135°) from the initial flow stream of pressurized fluid.

SUMMARY OF THE INVENTION

The apparatus claimed herein comprises a flow diverter adapted to divert an initial flow stream of pressurized fluid from a source of pressurized fluid. The flow diverter comprises a housing. The housing comprises an upstream end, an inlet opening in said upstream end, a downstream end generally opposed to said upstream end, a top plate extending between the upstream end and the downstream end, a bottom plate generally opposed to the top plate and extending between the upstream end and the downstream end, and a pair of generally opposed lateral sides extending between the upstream end, the downstream end, the top plate and the bottom plate. The upstream end of the housing is adapted to be attached to the source of pressurized fluid. The inlet opening in the upstream end of the housing is adapted to receive the initial flow stream of pressurized fluid from the source of pressurized fluid. The downstream end of the housing is adapted to divert the initial flow stream of pressurized fluid toward the pair of generally opposed lateral sides. The pair of generally opposed lateral sides are adapted to permit the initial flow stream of pressurized fluid to exit the housing in a pair of generally opposed diverted flow streams of pressurized fluid that are substantially perpendicular to the initial flow stream of pressurized fluid. The pair of generally opposed lateral sides are also adapted to permit the measurement of the initial flow stream of pressurized fluid.

In the preferred embodiment of the invention, the flow diverter includes at least one guide vane on the downstream end. The preferred at least one guide vane is adapted to divert the initial flow stream of pressurized fluid toward the substantially open and planar generally opposed lateral sides of the housing. The preferred embodiment of the invention also includes a nesting pin in the top plate and a nesting hole in the bottom plate. Also in the preferred embodiment of the invention, each of the substantially planar opposed lateral sides includes a discharge opening and a discharge screen which are substantially coplanar to the generally opposed lateral sides. The preferred generally opposed lateral sides also include a measurement opening. The preferred embodiment of the invention also includes an interior screen to divert the initial flow stream of pressurized fluid. The preferred embodiment of the invention further includes a handle having an open passageway and a chamber attached to and in fluid communication with the downstream end of the housing.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
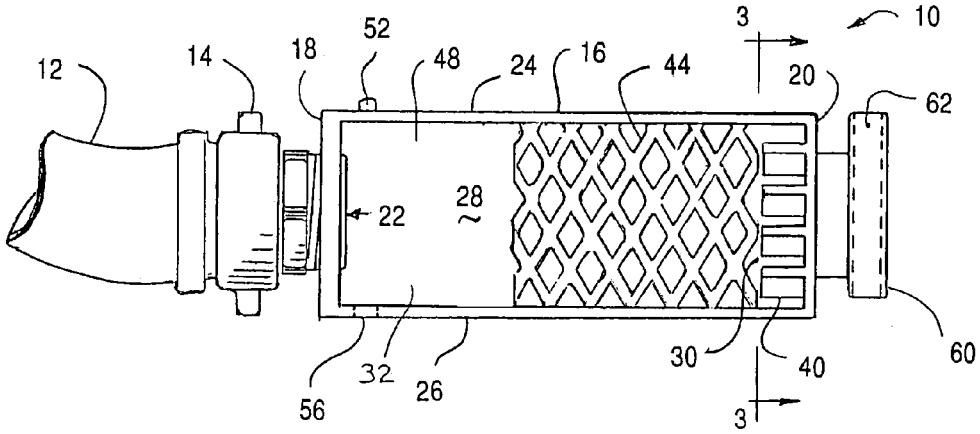
FIG. 1 is a side view of the preferred embodiment of the flow diverter of the present invention

Referring now to the drawings, the preferred embodiments of the apparatus and method for the flow diverter of the claimed invention are illustrated in FIGS. 1 through 9. More particularly, FIG. 1 is a side view of the preferred embodiment of the flow diverter of the invention in which preferred flow diverter is designated generally by reference numeral 10. As shown in FIG. 1, the preferred flow diverter 10 is adapted to be connected to a source of pressurized fluid such as hose 12 by a suitable connecting device such as swivel hose connector 14. The preferred hose 12 is connected to a high-pressure fluid system (not shown) such as a fire hydrant, a fire pump or the like to be tested. The preferred hose 12 is adapted to convey an initial flow stream of pressurized fluid to flow diverter 10. The preferred flow diverter 10 is adapted to divert the initial flow stream of pressurized fluid from the source of pressurized fluid.

Referring still to FIG. 1, the preferred flow diverter 10 comprises housing 16 having upstream end 18 and downstream end 20 opposite the upstream end. The preferred housing 16 has a square cross-sectional configuration as shown in FIG. 1. It is contemplated within the scope of the invention, however, that the cross-sectional shape of the housing may be circular, ovate, triangular, rectangular or any other suitable polygon. The preferred upstream end 18 is adapted to be removable attached to the source of pressurized fluid and includes inlet opening 22 (see also FIGS. 2, 4, 6 and 9) which is adapted to receive the initial flow stream of pressurized fluid from the source of pressurized fluid. The preferred downstream end 20 of the housing is adapted to divert the initial flow stream of pressurized fluid toward a pair of generally opposed lateral sides of the housing (and preferably toward a pair of generally opposed discharge openings), which are described below. The preferred housing 16 also includes top plate 24 and bottom plate 26 which extend between upstream end 18 and downstream end 20. The preferred top plate 24 and the preferred bottom plate 26 are adapted to prevent the initial flow stream of pressurized fluid from passing there through.

Still referring to FIG. 1, the preferred housing 16 also includes a pair of generally opposed lateral sides 28 which are substantially open. The preferred pair of generally opposed lateral sides 28 extend between upstream end 18, downstream end 20, top plate 24 and bottom plate 26. Each of the preferred pair of generally opposed lateral sides 28 includes discharge opening 30 which is located near the downstream end of the housing. The preferred pair of generally opposed discharge openings 30 are adapted to permit the initial flow stream of pressurized fluid to exit housing 16 in a pair of generally opposed diverted flow streams of pressurized fluid that are substantially perpendicular to the initial flow stream of pressurized fluid from the source of pressurized fluid. Further, each of the preferred pair of generally opposed lateral sides 28 includes a measurement opening 32 which is located upstream from the discharge opening. The preferred measurement openings 32 are adapted to permit the measurement of the initial flow stream of pressurized fluid from the source of pressurized fluid.

While FIG. 1 illustrates a housing having substantially open and generally opposed lateral sides, it is contemplated within the scope of the invention that the generally opposed lateral sides may have substantial areas that are closed, i.e., areas through which a flow stream of pressurized fluid may not pass. In addition, although the generally opposed lateral sides are illustrated in FIG. 1 as a pair of planar components, it is contemplated that the generally opposed lateral sides may be non-planar, e.g., arcuate, curved, ovate or the like. Further, although the generally opposed lateral sides are illustrated in FIG. 1 as a pair of substantially parallel sides, it is contemplated within the scope of the invention that the generally opposed lateral sides may be disposed in a non-parallel disposition relative to each other such as in the case of a housing having a cross-sectional shape of a circle, oval, triangle, pentagon, and the like. It is still further contemplated within the scope of the invention that the generally opposed lateral sides may be multi-faced such as in the case of a housing having a cross-sectional shape of a hexagon, an octagon, and the like.

Referring still to FIG. 1, the preferred flow diverter 10 includes one or more guide vanes 40 attached to downstream end 20 of housing 16. The preferred guide vanes 40 are adapted to divert the initial flow stream of pressurized fluid toward the generally opposed lateral sides of the housing. The preferred guide vanes 40 have a cross-sectional shape in the general shape of a rectangle, however, it is contemplated within the scope of the invention that the guide vanes may have a cross-sectional shape in any suitable shape adapted to divert the initial flow stream of pressurized fluid toward the generally opposed lateral sides of the housing.

Figure 3:
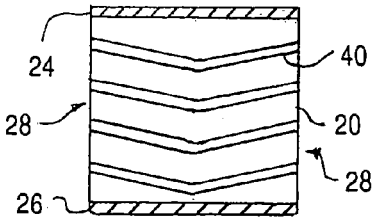
FIG. 3 is a sectional view of the preferred flow diverter illustrated by FIGS. 1 through 2 taken along sectional line 3—3.

The preferred guide vanes 40 are attached to downstream end 20 in an obtuse angle configuration wherein the vertex of the angle is closer to the bottom plate and the rays of the angle extend toward the top plate as shown more clearly in FIG. 3. It is contemplated within the scope of the invention, however, that the guide vanes may be configured in a curved, multi-sided or any other suitable configuration adapted to divert the initial flow stream of pressurized fluid toward the generally opposed lateral sides of the housing (see, e.g., FIG. 5). As shown in FIG. 1, the preferred guide vanes 40 include a plurality of guide vanes arranged in a vertically stacked arrangement at a distance from each other and symmetrically centered on the downstream end of the housing. It is contemplated within the scope of the invention, however, that one or more guide vanes may be attached to the downstream end of the housing. It is further contemplated within the scope of the invention the guide vanes may be arranged in any suitable arrangement adapted to divert the initial flow stream of pressurized fluid toward the generally opposed lateral sides of the housing.

Figure 4:
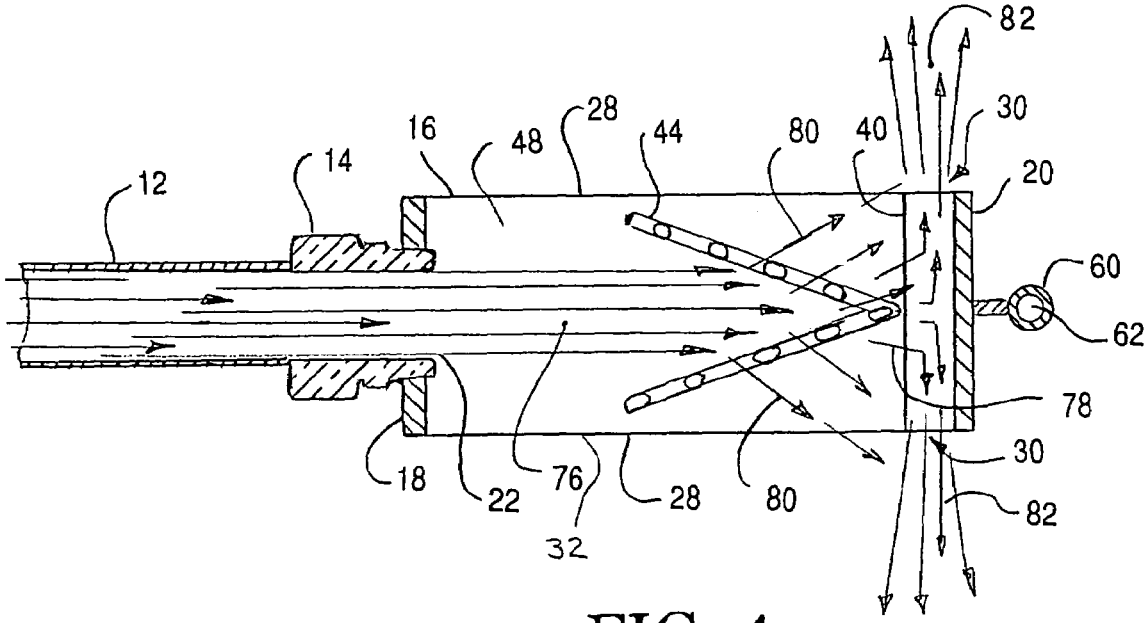
FIG. 4 is a sectional top view of the preferred flow diverter illustrated by FIGS. 1 through 3 showing the initial flow stream of pressurized fluid and the pair of diverted flow streams of pressurized fluid.
Figure 2:
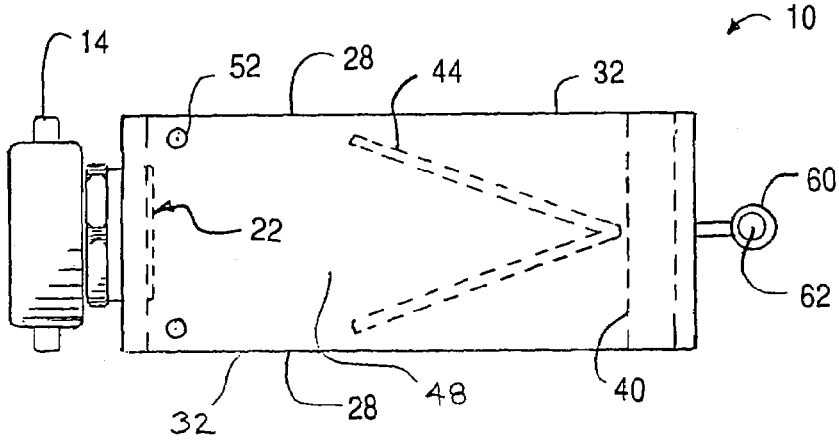
FIG. 2 is a partial sectional top view of the preferred flow diverter illustrated by FIG. 1.
Figure 8:
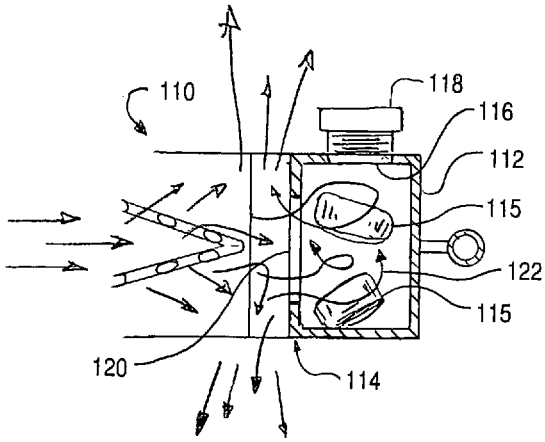
FIG. 8 is a sectional top view of the downstream end of an alternative embodiment of the flow diverter of the invention showing a chamber.

In a preferred embodiment, the hollow interior of housing 16 includes an interior screen such as expanded metal 44 which extends between top plate 24 and bottom plate 26 near the downstream end of the housing (see also FIGS. 2, 4 and 8). The preferred interior screen is adapted to contribute to the production of a pair of diverted flow streams of pressurized fluid. More particularly, the preferred interior screen is adapted to split the initial flow stream of pressurized fluid to cause a cover spray, thereby preventing fluid back splash into open interior area 48 which is located between the interior screen and upstream end 18 of the housing. While expanded metal 44 is the preferred interior screen, it is contemplated within the scope of the invention that wire mesh, wire mesh screen, and other similar constructions may be used to form the interior screen for the flow diverter.

In addition, while expanded metal 44 is shown to be configured in the general shape of a letter "V" as viewed from the top of the flow diverter (see FIGS. 2, 4 and 8), it is contemplated within the scope of the invention that the configuration of the interior screen may be any suitable configuration for contributing to the production of the pair of diverted flow streams of pressurized fluid and for splitting the initial flow stream of pressurized fluid to produce a cover spray, thereby preventing fluid back splash into the open interior area between the interior screen and upstream end of the housing. For example, it is contemplated within the scope of the invention that the interior screen may be configured in the general shape of a letter "M" (as viewed from the top of the flow diverter). It is also contemplated within the scope of the invention that the interior screen may be configured in curved, arcuate, ovate, zig-zag, stepped, or any other suitable configuration adapted to contribute to the production of a pair of diverted flow streams of pressurized fluid. It is further contemplated within the scope of the invention that the interior screen may comprise one or more rods, pins or other similar structures extending between the top plate and the bottom plate.

Figure 6:
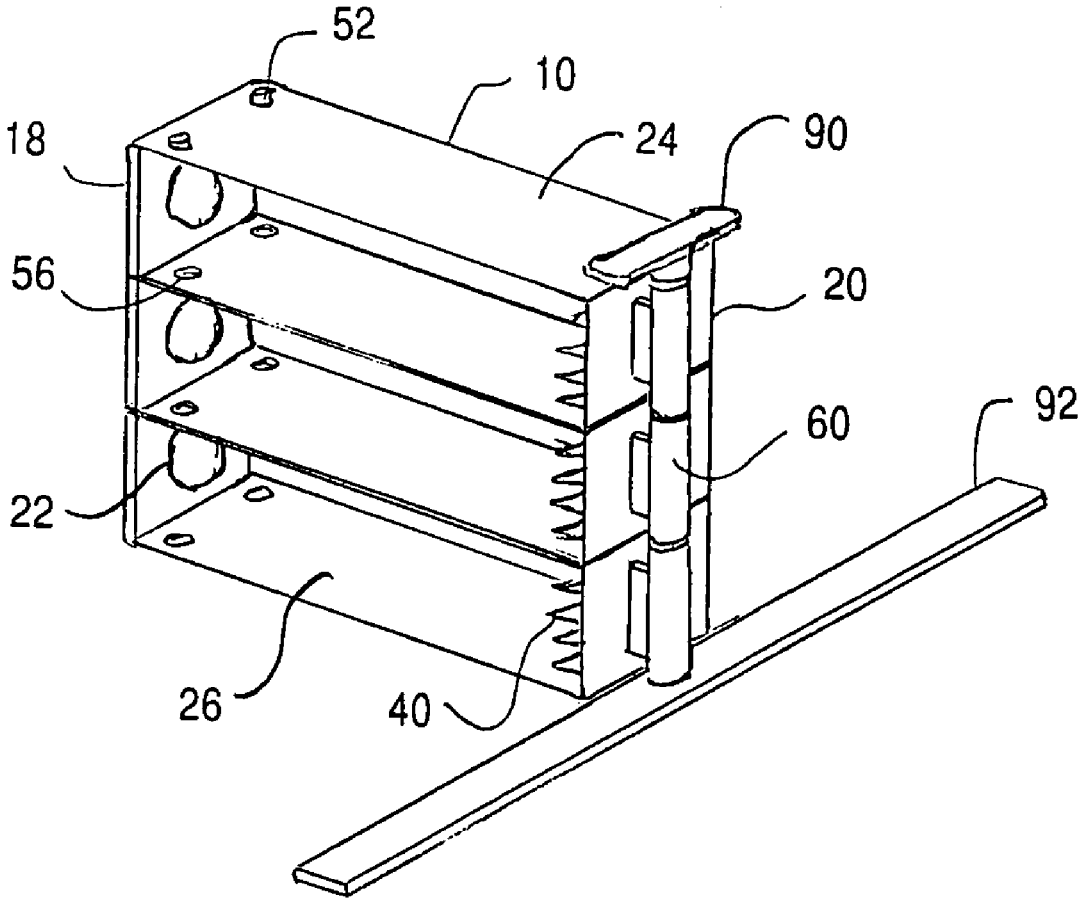
FIG. 6 is a perspective view of three of the preferred flow diverters illustrated by FIGS. 1 through 4 shown in a stacked configuration with the interior screens removed for clarity.

Still referring to FIG. 1, the preferred flow diverter 10 includes a means for removably securing the flow diverter to another flow diverter such as nesting pin 52 on top plate 24 and nesting hole 56 on bottom plate 26. The preferred nesting pin 52 is adapted to be removably retained by the preferred nesting hole 56 on another flow diverter device. As shown in FIG. 1, the preferred nesting pin 52 and the preferred nesting hole 56 are adapted to align with each other so as to permit the stacking of multiple flow diverters 10 such as when stacking of multiple flow diverters is required for testing purposes. As shown in FIG. 6, when multiple flow diverters are stacked, the nesting hole of the flow diverter stacked directly above another flow diverter is aligned so as to mate with the nesting pin of the flow diverter stacked directly beneath it. While nesting pin 52 and nesting hole 56 are illustrated as the preferred means for removably securing the flow diverter to another flow diverter, it is contemplated within the scope of the invention that the means for removably securing the flow diverter to another flow diverter may be a pair of tabs on the top or bottom plate of the flow diverter which are adapted to cradle and removably retain another flow diverter, a mating slot and tab arrangement, and the like.

Referring again to FIG. 1, the preferred flow diverter 10 also includes handle 60. The preferred handle 60 is connected to the downstream end 20 of the housing. The preferred handle 60 also includes open passageway 62 so that it is adapted to receive alignment holding bar 90 (see FIGS. 6 and 7) which may be used to stabilize the flow diverter such as when multiple flow diverters are stacked.

Referring now to FIG. 2, a partial sectional top view of the preferred flow diverter 10 is illustrated. As shown in FIG. 2, the preferred interior screen is configured in the general shape of a letter "V" (as viewed from the top of the flow diverter) and handle 60 is a substantially hollow tube. As shown more clearly in FIG. 4, the "V"-shaped configuration of the preferred interior screen is adapted to contribute to the production of a pair of diverted flow streams of pressurized fluid and to split the initial flow stream of pressurized fluid in order to provide a cover spray and thereby prevent back splash by the pair of diverted streams of pressurized fluid.

Referring now to FIG. 3, a sectional view taken along sectional line 3—3 is illustrated. As shown in FIG. 3, the preferred configuration of guide vanes 40 is in the general shape of an obtuse angle with the vertex of the angle closer to the bottom plate of the housing and the two rays of the angle extending toward the top plate. As also shown in FIG. 3, the preferred flow diverter 10 includes four guide vanes 40 which are vertically spaced apart from each other at a substantially uniform distance and centered in a symmetrical arrangement on the downstream end of the housing. It is contemplated within the scope of the invention, however, that the configuration, number and arrangement of the guide vanes may be any suitable combination that is adapted to divert the initial flow stream of pressurized fluid toward the generally opposed lateral sides of the housing of the flow diverter.

Figure 5:
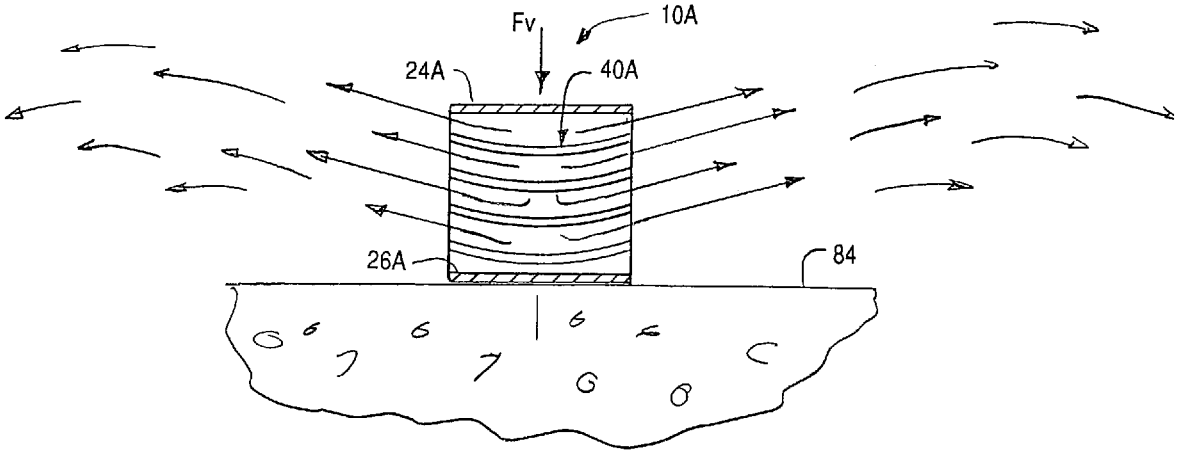
FIG. 5 is a sectional end view of an alternative embodiment of the flow diverter of the invention showing a preferred set of guide vanes.

Referring now to FIG. 4 and FIG. 5, the preferred initial flow stream of pressurized fluid and the preferred diverted flow stream of pressurized fluid are illustrated. More particularly, FIG. 4 is a sectional top view of the preferred flow diverter 10 showing the initial flow stream of pressurized fluid and the pair diverted flow streams of pressurized fluid. As shown in FIG. 4, the preferred initial flow stream of pressurized fluid 76 is conveyed by a source of pressurized fluid such as hose 12 through swivel hose connector 14 into open interior area 48 of the interior of housing 16 under laminar flow. The initial flow stream of pressurized fluid then preferably passes through an interior screen such as expanded metal 44 which partially diverts the initial flow stream of pressurized fluid toward the generally opposed lateral sides of the housing. More particularly, in the preferred flow diverter 10, the initial flow stream of pressurized fluid 76 is split by the interior screen, thereby redirecting inward flow 78 to the vane area and outward flow 80 towards the generally opposed lateral sides of the housing. This outward flow 80 produces a protective cover spray redirecting any back splash of misdirected fluid away from open interior area 48.

Still referring to FIG. 4, the flow stream of pressurized fluid then preferably contacts guides vanes 40 and downstream end 20 of the housing and is diverted into a pair of diverted flow streams of pressurized fluid 82 toward the generally opposed lateral sides of the housing. Thereafter, the pair of diverted flow streams of pressurized fluid preferably exits the housing through the discharge openings. The preferred guide vanes sectionalize the flow stream of pressurized fluid stream and direct the fluid out of the flow diverter equally on each generally opposed lateral side. The preferred initial flow stream of pressurized fluid is therefore split into two diverted flow streams of pressurized fluid which exit the generally opposed lateral sides of the flow diverter. The preferred equal and opposite flow directions of the two diverted flow streams of pressurized fluid cancel the opposing thrust forces resulting therefrom and result in a balanced and stable flow diverter.

While the preferred pair of diverted flow streams of pressurized fluid are illustrated in FIG. 4 two flow streams that are approximately one hundred and eighty degrees (180°) apart from each other and approximately ninety degrees (90°) apart from the initial flow stream of pressurized fluid, it is contemplated within the scope of the invention that the pair of diverted flow streams of pressurized fluid may include more than two diverted flow streams of pressurized fluid. It is also contemplated within the scope of the invention that the pair of diverted flow streams of pressurized fluid may include a plurality of flow streams that are not one hundred and eighty degrees (180°) apart from each other. For example, the pair of diverted flow streams may include four flow streams in which each adjacent flow stream is approximately ninety (90°) from the other, provided that the flow streams directed toward each of the generally opposed lateral sides produces a horizontal thrust force that is substantially equal to the other. In such an example, two flow streams would be directed toward one generally opposed lateral side and the other two flow streams would be directed toward the other generally opposed lateral side. It is further contemplated within the scope of the invention that the pair of diverted flow streams of pressurized fluid may include a plurality of flow streams that are each separated from the initial flow stream of pressurized fluid by between approximately forty-five degrees (45°) and approximately one hundred thirty-five degrees (135°).

As shown in FIG. 5, a sectional end view of an alternative embodiment of the flow diverter of the invention is illustrated. More particularly, the preferred flow diverter 10A includes top plate 24A, bottom plate 26A and guide vanes 40A. The preferred guide vanes 40A are curved upwardly so as to direct the flow stream of pressurized fluid slightly upward and thereby produce a downward force Fv on ground surface 84. In doing so, the fluid is elevated on its exit from flow diverter 10A. By elevating the fluid on exit, the preferred flow diverter may be placed on a less than ideal ground surface without causing surface damage or gouging during its use. In addition, because the fluid is preferably elevated, it falls on ground surfaces farther away and further spread out from the immediate discharge area. Consequently, damage to landscaping and grass areas is minimized. Still further, the downward force Fv stabilizes the preferred flow diverter during operation and particularly during multiple unit stacking operations. It is contemplated within the scope of the invention, however, that the guide vanes may be substantially parallel to the top plate and/or the bottom plate and may include elements that are downwardly sloped towards one or both generally opposed lateral sides.

Referring again to FIG. 4, Pitot tube (not shown) measurements may be made in the open interior area 48. The Pitot tube may be braced against swivel hose connector 14 as it protrudes through upstream end 18. The operator is free to take flow readings in open interior area 48 without experiencing any interference from the pressurized fluid because the outward flow 80 produces a protective cover spray redirecting any back splash of misdirected fluid away from the open interior area 48.

Referring now to FIG. 6, three of the preferred flow diverters 10 are shown in a stacked configuration (the interior screens have been removed for clarity). An alignment holding bar 90, preferably with a "T" handle, is inserted through the open passageway of each flow diverter handle 60. The preferred alignment holding bar 90 is adapted to be screwed into stabilizing bar 92. The preferred stabilizing bar 92 is adapted to prevent accidental tipping of a multiple unit stack during operation. The upstream ends 18 of the flow diverters are preferably aligned by placing the nesting pins 52 of a flow diverter directly beneath another flow diverter into the nesting holes 56 of the flow diverter directly above it.

Figure 7:
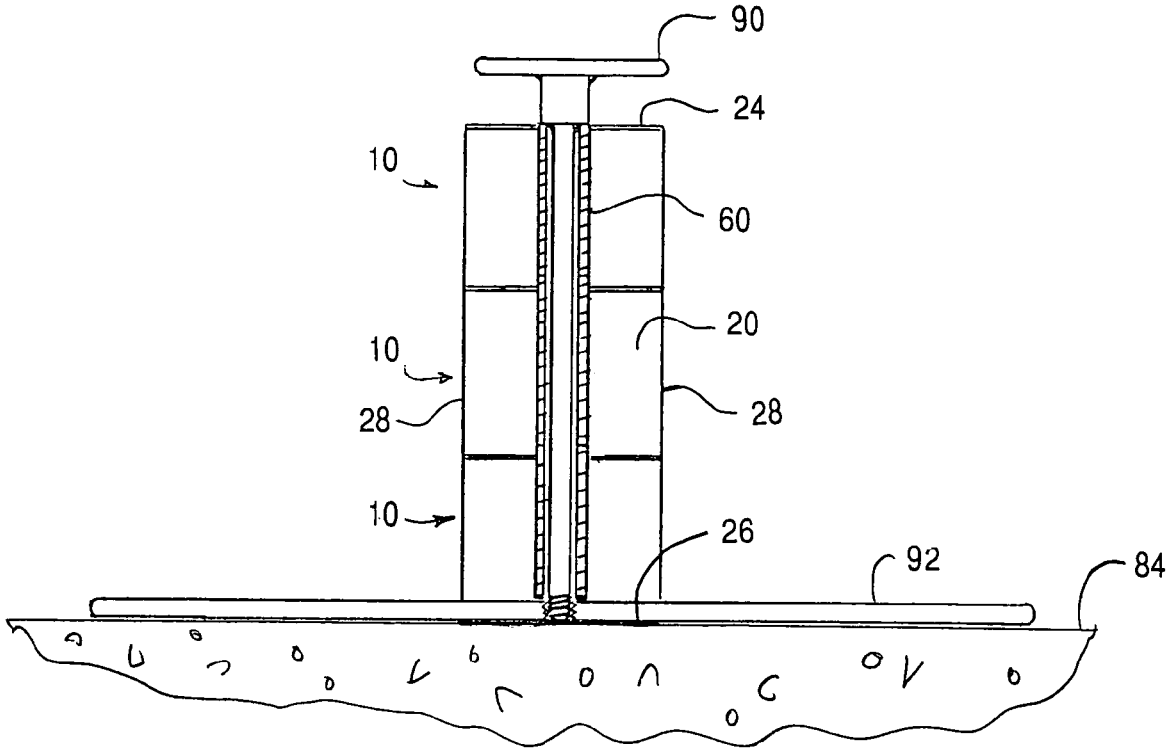
FIG. 7 is a sectional end view of a three stacked flow diverters illustrated by FIG. 6.

Referring now to FIG. 7, a sectional end view of a three stacked flow diverters shown in FIG. 6 is illustrated. More particularly, FIG. 7 is a sectional view taken along a line dissecting the handles of the preferred flow diverter 10 so as to illustrate the alignment holding bar 90 and the threaded connection between alignment holding bar 90 and stabilizing bar 92.

Referring now to FIG. 8, a sectional top view of the downstream end of an alternative embodiment of the flow diverter of the invention is illustrated. More particularly, the preferred flow diverter 110 includes chamber 112 which is attached to the downstream end 114 of the flow diverter. The preferred chamber 112 is adapted to provide a means for mixing a foreign substance with the flow stream of pressurized fluid such as dechlorinator tablets 115. As shown in FIG. 8, the preferred chamber 112 includes side opening 116 which may be covered by cap 118. A foreign substance such as preferred dechlorinator tablets 115 may be placed into chamber 112 by removing cap 118 and passing the tablets through side opening 116. Also in the preferred flow diverter 110, the downstream end 114 includes one or more holes 120 (see FIG. 9) which allow fluid from the flow stream of pressurized fluid to enter chamber 112 and interact with tablets 115. The turbulent mixing between the flow stream (shown by flow lines 122) and the tablets dissolves the tablets so as to release the chemicals and dechlorinate the flow stream.

Figure 9:
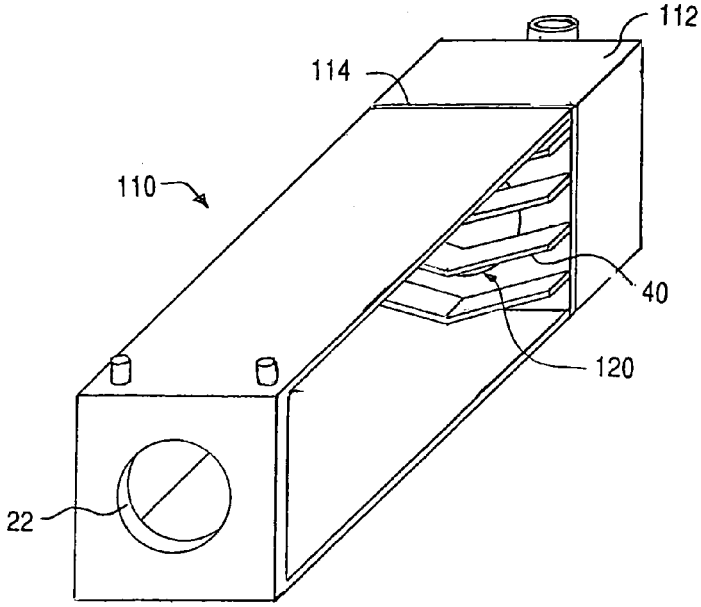
FIG. 9 is a perspective view of the preferred flow diverter illustrated by FIG. 8 with the interior screen removed for clarity.

Referring now to FIG. 9, a perspective view of the preferred flow diverter 110 shown in FIG. 8 is illustrated (the interior screen has been removed for clarity). More particularly, as shown in FIG. 9, the preferred flow diverter 110 includes chamber 112 mounted to downstream end 114. In the preferred embodiment, a single hole 120 is drilled into downstream end 114 in order to permit the mixing of the flow stream with the tablets placed in chamber 112. It is contemplated within the scope of the invention, however, that more than a single hole may be drilled into the downstream end. It is also contemplated that slots, vents or any other suitable opening may be provided in the downstream end so as to permit the mixing of the flow stream and the contents of the chamber. It is further contemplated within the scope of the invention that the chamber may be used for purposes other than dechlorinating the flow stream, and that the chamber may be any suitable configuration adapted for such a purpose.

In operation, several advantages of the flow diverter of the invention are achieved. For example, the preferred flow diverter of the invention is adapted to divert, measure, dissipate, and dechlorinate a flow stream of pressurized fluid. More particularly, the preferred flow diverter is adapted to receive an initial flow stream of pressurized fluid and divert it toward a pair of generally opposed lateral sides at an angle substantially perpendicular to the initial flow stream direction. The preferred guide vanes of the flow diverter achieve a balanced horizontal thrust while imparting a slight vertical thrust to prevent incidental movement of the flow diverter during use. When imparting the vertical thrust, the preferred guide vanes elevate the redirected fluid to prevent damage to the ground surfaces, landscaping and the like in the area around the fluid diverter.

Dechlorination of the flow stream of pressurized fluid may be accomplished by a chamber mounted at the downstream end of the preferred flow diverter. A hole or a plurality of holes (or other openings) may be drilled into the downstream end of the preferred housing in order to permit the mixing of the flow stream of pressurized fluid and the contents of the chamber. A chemical tablet or the like may be placed into the chamber through a side entrance. The tablet is adapted to dissolve in the portion of the flow stream of pressurized fluid that enters the chamber and exit the chamber at a rate designed to achieve efficient dechlorination of the flow stream.

The sides of the preferred flow diverter are substantially open so as to allow unrestricted access to the initial flow stream of pressurized fluid in order to measure the flow using a flow measurement device (typically a hand held Pitot tube) in the initial flow stream. Unrestricted access permits the operator to obtain higher accuracy readings than those flow diverter designs which require the Pitot tube to be placed in a fixed position.

Fluid back splash is prevented by an interior screen which splits the flow stream upstream from the guide vanes so as to provide a cover spray. The cover spray prevents the diverted flow stream of pressurized fluid from spraying back toward the open interior area and the operator.

The prevention of back splash combined with the guide vanes permits the size and weight of the preferred flow diverter to be reduced. The reduced size and weight of the preferred flow diverter together with the preferred hollow handle permit the flow diverter to be easily carried to any application. Storage space is also reduced compared to conventional flow diverters. More particularly, the absence of a "T"-shaped housing reduces the size and weight of the preferred flow diverter and improves the portability and storability of the preferred flow diverters of the invention.

The preferred flow diverter also encompasses a nesting feature that permits the vertical stacking of multiple flow diverters. The preferred nesting feature includes the hollow handle adapted to receive a rod which vertically aligns multiple flow diverter devices and secures them to a suitable support plate. In addition, nesting pins are adapted to mate with nesting holes in the preferred flow diverter. The alignment rod is adapted to extend through the handles of the flow diverter and screw into a support plate in order to prevent accidental tipping of the stacked flow diverters.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalence of the appended claims.

What is claimed is:

1. A flow diverter adapted to divert an initial flow stream of pressurized fluid from a source of pressurized fluid, said flow diverter comprising:

a housing, said housing comprising:

an upstream end;

an inlet opening in said upstream end;

a downstream end generally opposed to said upstream end;

a top plate extending between the upstream end and the downstream end;

a bottom plate generally opposed to the top plate, said bottom plate extending between the upstream end and the downstream end;

a pair of generally opposed lateral sides extending between the upstream end, the downstream end, the top plate and the bottom plate;

wherein each lateral side includes a discharge opening therein;

wherein the upstream end of the housing is adapted to be attached to the source of pressurized fluid;

the inlet opening in the upstream end of the housing is adapted to receive the initial flow stream of pressurized fluid from the source of pressurized fluid;

the downstream end of the housing diverts the initial flow stream of pressurized fluid toward the pair of generally opposed lateral sides;

the pair of generally opposed lateral sides permit the initial flow stream of pressurized fluid to exit the housing through the discharge openings in a pair of generally opposed diverted flow streams of pressurized fluid that are substantially perpendicular to the initial flow stream of pressurized fluid;

and the pair of generally opposed lateral sides permit the measurement of the initial flow stream of pressurized fluid.

2. The flow diverter of claim 1 wherein the downstream end of the housing includes at least one guide vane adapted to divert the initial flow stream of pressurized fluid toward the pair of generally opposed lateral sides of the housing.

3. The flow diverter of claim 2 wherein the at least one guide vane is configured so as to cause the pair of diverted flow streams of pressurized fluid to be elevated relative to the bottom plate.

4. The flow diverter of claim 2 wherein the at least one guide vane is configured so as to produce a downward force imparted on the housing by the flow stream of pressurized fluid.

5. The flow diverter of claim 2 wherein the at least one guide vane is configured in the general shape of an obtuse angle.

6. The flow diverter of claim 1 further comprising a means for removably securing the flow diverter to another flow diverter.

7. The flow diverter of claim 6 wherein the means for removably securing the flow diverter to another flow diverter comprises a nesting pin on the top plate and a nesting hole on the bottom plate, said nesting pin and said nesting hole being adapted to align with a second nesting hole and a second nesting pin, respectively, on said another flow diverter.

8. The flow diverter of claim 1 wherein each of the pair of generally opposed lateral sides is substantially open.

9. The flow diverter of claim 1 wherein each of the pair of generally opposed lateral sides is substantially planar.

10. The flow diverter of claim 1 wherein each of the pair of generally opposed lateral sides includes a discharge opening located near the downstream end of the housing.

11. The flow diverter of claim 10 wherein each of the discharge openings is substantially coplanar to one of the generally opposed lateral sides.

12. The flow diverter of claim 10 wherein each of the discharge openings includes a discharge screen.

13. The flow diverter of claim 10 wherein each of the discharge screens is substantially coplanar to one of the generally opposed lateral sides of the housing.

14. The flow diverter of claim 1 wherein at least one of the generally opposed lateral sides includes a measurement opening, said measurement opening being located near the upstream end of the housing.

15. The flow diverter of claim 1 wherein at least one of the generally opposed lateral sides includes a measurement opening, said measurement opening being located upstream from the discharge openings.

16. The flow diverter of claim 1 wherein the housing has an open interior area.

17. The flow diverter of claim 16 wherein the open interior area of the housing includes an interior screen, said interior screen being adapted to divert the initial flow stream of pressurized fluid.

18. The flow diverter of claim 17 wherein the interior screen is configured in the general shape of a letter "V".

19. The flow diverter of claim 1 further comprising a handle mounted to the downstream end of the housing.

20. The flow diverter of claim 19 wherein the handle includes an open passageway.

21. The flow diverter of claim 1 further comprises a chamber attached to and in fluid communication with the downstream end of the housing.

22. The flow diverter of claim 21 wherein the chamber is adapted to permit mixing of the flow stream of pressurized fluid with a foreign substance.

23. A method for diverting an initial flow stream of pressurized fluid from a source of pressurized fluid, said method comprising:

(1) providing a flow diverter to divert the initial flow stream of pressurized fluid from the source of pressurized fluid, said flow diverter comprising:

(a) a housing, said housing comprising:

(b) an upstream end;

(c) an inlet opening in said upstream end;

(d) a downstream end generally opposed to said upstream end;

(e) a top plate extending between the upstream end and the downstream end;

(f) a bottom plate generally opposed to the top plate, said bottom plate extending between the upstream end and the downstream end;

(g) a pair of generally opposed lateral sides extending between the upstream end, the downstream end, the top plate and the bottom plate;

wherein each lateral side includes a discharge opening therein;

wherein the upstream end of the housing is attached to the source of pressurized fluid;

the inlet opening in the upstream end of the housing is adapted to receive the initial flow stream of pressurized fluid from the source of pressurized fluid;

the downstream end of the housing diverts the initial flow stream of pressurized fluid toward the pair of generally opposed lateral sides;

the pair of generally opposed lateral sides permit the initial flow stream of pressurized fluid to exit the housing through the discharge openings in a pair of generally opposed diverted flow streams of pressurized fluid that are substantially perpendicular to the initial flow stream of pressurized fluid;

and the pair of generally opposed lateral sides are adapted to permit the measurement of the initial flow stream of pressurized fluid;

(2) supplying the initial flow stream of pressurized fluid to the flow diverter;

(3) diverting the initial flow stream of pressurized fluid into a pair of generally opposed diverted flow streams of pressurized fluid.

* * * * *